US006131384A

United States Patent [19]

Ebel

[11] Patent Number: 6,131,384

[45] Date of Patent: Oct. 17, 2000

[54] SUSPENSION DEVICE FOR ANNULAR GAS TURBINE COMBUSTION CHAMBERS

[75] Inventor: Michael Ebel, Rangsdorf, Germany

[73] Assignee: Rolls-Royce Deutschland GmbH, Dahlewitz, Germany

[21] Appl. No.: 09/134,578

[22] Filed: Aug. 14, 1998

[30] Foreign Application Priority Data

Oct. 16, 1997 [DE] Germany ..... 197 45 683

[51] Int. Cl.[7] ..... F02C 7/20

[52] U.S. Cl. ..... 60/39.31; 60/39.32

[58] Field of Search ..... 60/39.36, 39.31, 60/39.32, 752

[56] References Cited

U.S. PATENT DOCUMENTS 3,670,497 6/1972 Sheldon ..... 60/39.32

5,333,443 8/1994 Halila ..... 60/39.31

FOREIGN PATENT DOCUMENTS

564172 A1 10/1993 European Pat. Off. .

*Primary Examiner*—Louis J. Casaregola

*Attorney, Agent, or Firm*—W. Warren Taltavull; Farkas & Manelli PLLC

[57] ABSTRACT

In a gas turbine engine, the exit end of a combustion chamber of annular shape is suspended from the interior wall of the engine casing by an elbow structure which is detachably mounted on a flange by one of its two legs; the resilience of the elbow structure is improved by dove-tail shaped openings provided in the elbow structure with the narrowest section of the openings facing the bend line of the elbow structure to define with the opening of the other leg a gap that enables the elbow structure to function as a leaf-spring.

10 Claims, 2 Drawing Sheets

SUSPENSION DEVICE FOR ANNULAR GAS TURBINE COMBUSTION CHAMBERS

FIELD AND BACKGROUND OF THE INVENTION

This invention relates to means for suspending an annular gas turbine combustion chamber in its exit area on a casing wall by an annular elbow structure connecting to the outer combustion chamber wall, said elbow structure having an outer and an inner leg, as viewed with reference to the longitudinal centerline of the gas turbine. For relevant prior art, reference is made to EP O 564 172 Al.

Annular combustion chambers of gas turbines are normally suspended at their forward end by the burners projecting into the combustion chamber interior, while at their aft end, or exit area, they are suitably attached to a casing wall, or combustion chamber outer casing. In the case of an effusion-cooled combustion chamber wall having a plurality of cooling air holes, or effusion holes, care must be taken to provide sufficient cooling also for the aft combustion chamber wall section. The supporting structure for the combustion chamber suspension means must therefore not be allowed to interfere with effective cooling in this area. A suspension means or supporting structure meeting these requirements is shown in the above-cited EP O 564 172 Al. This annular elbow structure, which among engineers skilled in the art is termed "hairpin", has, with reference to the gas turbine longitudinal centerline, an inner and an outer leg, with the two legs enclosing an acute angle between them and the inner leg being inclined at an acute angle to the combustion chamber wall, so that a wedge-shaped annular gap is formed between the inner leg and the combustion chamber wall which opens towards the efflux direction of the cooling air flowing along the outer side of the outer combustion chamber wall, so that cooling air is optimally allowed to reach the farthest end of the combustion chamber wall.

In the prior art, the use of the elbow structure or hairpin arrangement on the outer wall of the annular combustion chamber simply involves the latter merely lodging by means of the elbow structure against the casing wall surrounding the combustion chamber wall, while the actual attachment of the combustion chamber is effected by the inner wall of the annular combustion chamber. This may cause an undesirable amount of relative movement at the extreme aft section of the combustion chamber.

SUMMARY OF THE INVENTION

The object of the present invention is to provide an improvement over the combustion chamber suspension means of the prior art. The attainment of this object is characterized in that the outer leg of the elbow structure is connected to a flange which by a fastening device is fixedly connected to the casing wall surrounding the combustion chamber wall. Further advantageous embodiments and developments of the present invention are described and claimed below. In a preferred embodiment, the two legs have dovetail-shaped openings or breakthroughs equally spaced over the circumference and whose narrowest sections face the bend line of the elbow structure and are open toward it, so that a connecting gap is formed between each breakthrough in the outer leg and the adjacent breakthrough in the inner leg. This provides an advantageous suspension means of the leaf-spring type.

BRIEF DESCRIPTION OF THE INVENTION

Further aspects and advantages of the present invention are described more fully in a preferred embodiment shown on the accompanying drawings, in which FIG. 1 shows a partial section through an annular gas turbine combustion chamber having a suspension means in accordance with the present invention, FIG. 2 shows view along lines 2—2 of from FIG. 1 as a partial development of the annular elbow structure, and FIG. 3 shows essential elements along lines 3—3 of FIG. 1.

DETAILED DESCRIPTION OF THE INVENTION

Figure 1:
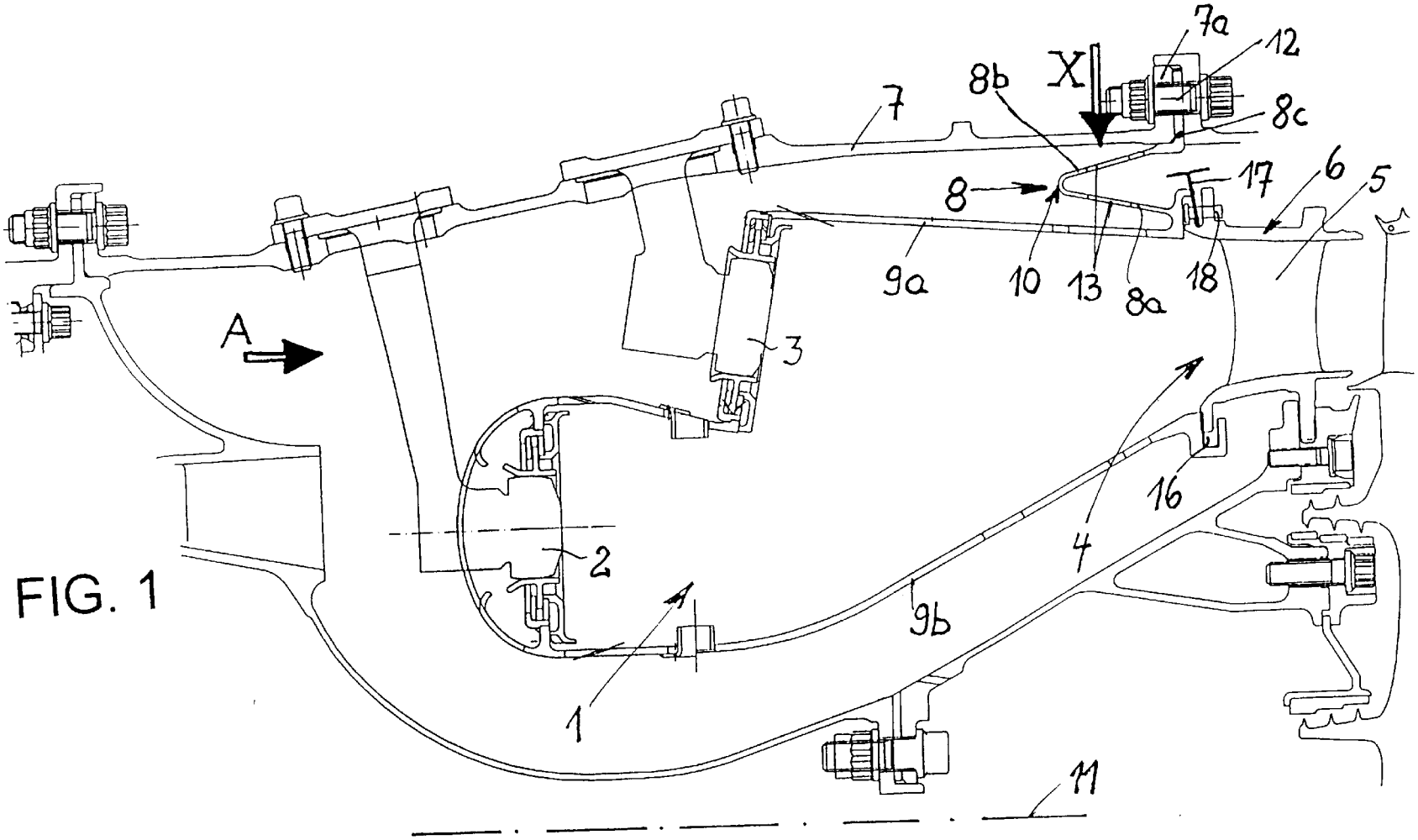

The numeral 1 indicates the annular combustion chamber of a gas turbine, the combustion chamber being staged and having at its front end a plurality of annularly arranged pilot burners 2 and annularly arranged main burners 3. The combustion chamber 1 is suspended at or adjacent its exit area 4 on a casing wall 7 surrounding the entire combustion chamber structure, with the combustion chamber 1 being directly followed by a stator ring 6 having a plurality of vanes 5. For the purpose, an annular elbow structure 8 is provided that connects to or immediately adjacent to the aft end or the extreme section of the outer combustion chamber wall 9*a*. Owing to the bend along the annular bend line 10 this elbow structure 8 has an inner leg 8*a* and an outer leg 8*b*, where inner and outer here indicate their position relative to the longitudinal centerline 11 of the gas turbine. The legs 8*a* and 8*b* meet at the bend line 10 to enclose an acute angle between them. An acute angle is enclosed also between the outer combustion chamber wall 9*a* and the inner leg 8*a*, as well as between the casing wall 7 and the outer leg 8*b*. Connecting to the far end of the outer leg 8*b*, pointing away from bend line 10, is a radially extending flange 8*c* connecting, by means of a fastening device 12 (which takes the shape of a bolt-and-nut connection), to a flange 7*a* on the casing wall 7, said flange again extending radially, i.e. normal to the longitudinal centerline 11 of the gas turbine. A plurality of such fastening devices 12 are spaced around the circumference of the combustion chamber 1 or casing wall 7, to secure suspension of the combustion chamber 1 which is achieved so as to more particularly prevent undesirable relative movement of the combustion chamber 1 in the vicinity of the exit area 4.

The combustion chamber 1 should nevertheless be allowed some degree of movement relative to the casing wall 7. This freedom of movement is achieved by means of openings or punchouts 13 in the elbow structure 8, or in the legs 8*a*, 8*b*.

When these openings 13 are suitably sized and arranged in at least one of the legs 8*a*, 8*b*, preferably however in both legs 8*a*, 8*b*, the elbow structure 8 operates like a leaf spring of selectable properties, with the best results achieved when openings 13 in the elbow structure 8 are used which are designed and arranged as described below.

Figure 2:
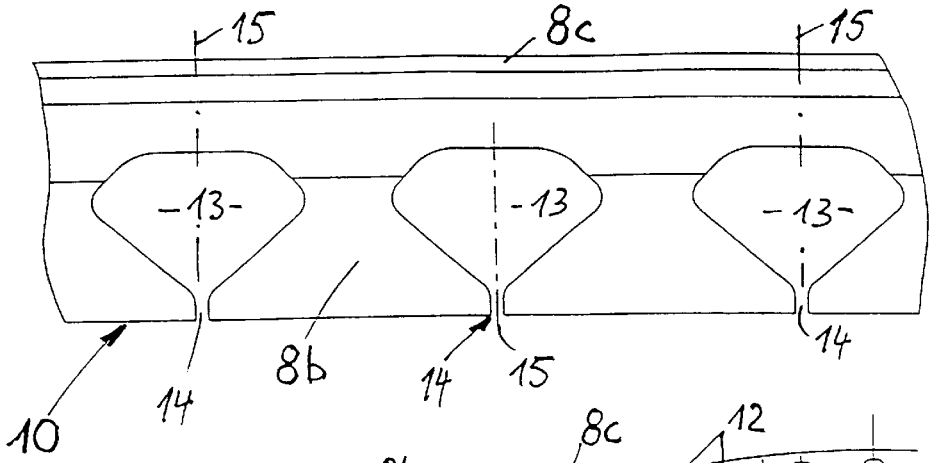

As shown in FIG. 2, the breakthroughs 13 are dovetail-shaped and equally spaced around the circumference of the two legs 8*a*, 8*b*, with the narrowest sections of the openings 13 each facing the bend line 10 of the elbow structure 8. The openings 13 open toward the bend line, so that—with the openings in the outer leg 8*b* and the inner leg 8*a* virtually coinciding as shown in FIG. 1—a connecting gap 14 is formed between each opening 13 in the outer leg 8*b* and the adjacent opening 13 in the inner leg 8*a*. This arrangement provides adequate resilience to absorb expansion of the combustion chamber 1 relative to the casing wall 7, but still gives adequate strength to safely suspend the combustion chamber 1 on the casing wall 7.

Figure 3:
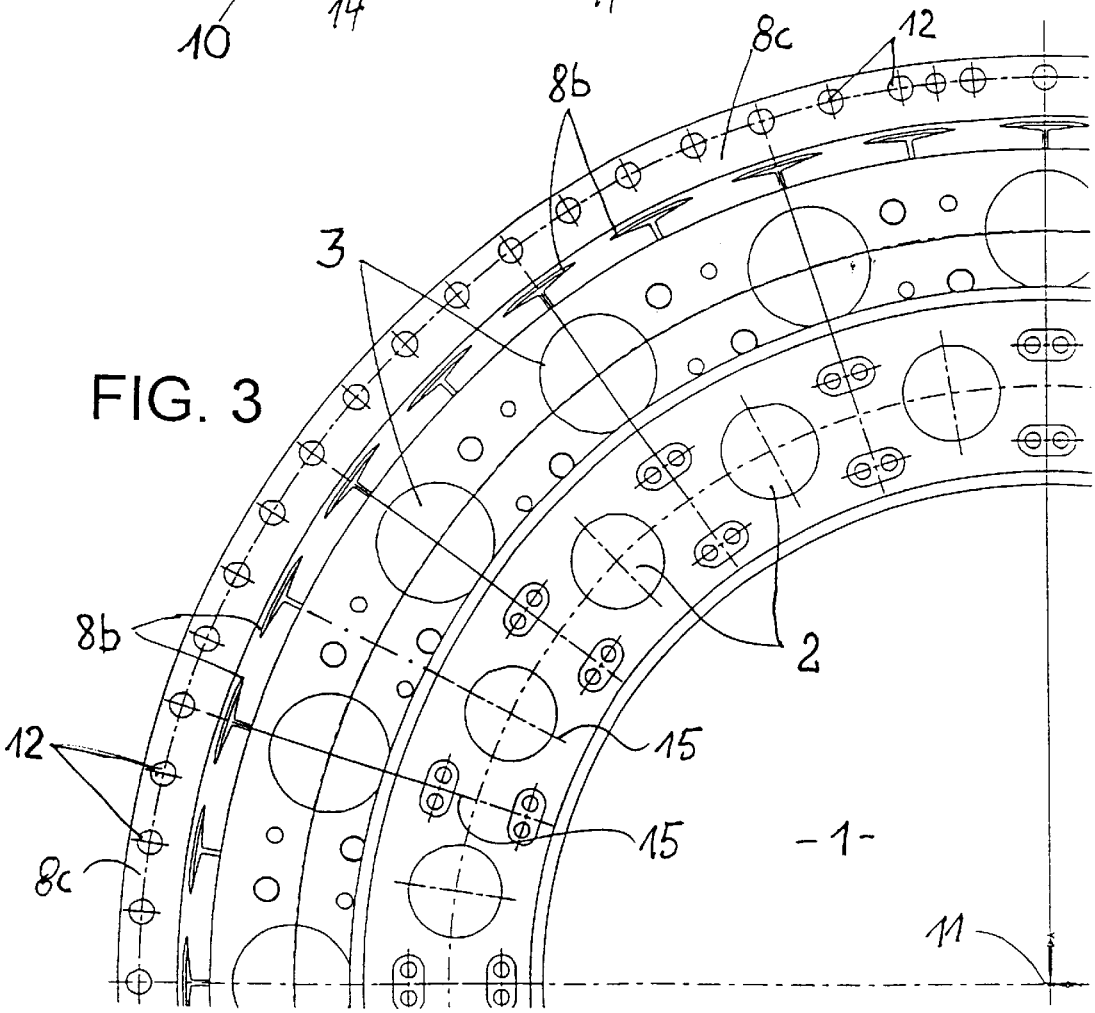

As shown for the staged annular combustion chamber 1 of FIG. 3, the pilot burners 2 and the main burners 3 are staggered circumferentially relative to each other. For optimum suspension of the combustion chamber in accordance with the present invention, an opening 13 is provided in at least one, however preferably both legs 8*a*, 8*b* in the sectional plane 15 of each burner (this sectional plane 15 conventionally extending through the burner 2 or 3 itself and through the longitudinal centerline 11 of the gas turbine), where the connecting gap 14 is also in this sectional plane 15.

In an alternative arrangement the openings 13 are circumferentially offset relative to the burners 2, causing the sectional planes 15 of the various burners 2, 3 to be for example exactly central between two adjacent openings 13 (omitted on the drawing). Further arrangements would use any random intermediate positions of the breakthroughs 13 in the legs 8*a* and/or 8*b* relative to the sectional planes 15 of the burners.

The present embodiment provides exactly one opening 13 in the two legs 8*a*, 8*b* for each sectional plane 15 of the burners, i.e. the quotient of the number of breakthroughs 13 in one of the legs 8*a* and 8*b*, respectively (counted over its entire circumference) divided by the total number of burners 2, 3 here gives exactly "1". Alternatively this quotient (number of openings divided by the total number of burners) may also be some other appropriate value, for example 0.5 or 1.5, or 2 or 2.5 or 3, the integer values of this quotient being advantageous for the simple periodic iteration. In other words, this means that, alternatively, only half as many openings or punchouts 13 are provided in the legs 8*a*, 8*b* of the elbow structure 8 as there are burners 2, 3, or that there are three times as many openings 13 than there are burners. It should be noted, however, that for unstaged combustion chambers, different numerical values of said quotient may be appropriate than for the staged combustion chambers indicated above.

With the aid of the arrangement or combustion chamber suspension means described, the annular combustion chamber 1 can be optimally adapted in of function, weight and life. One reason for the improvements is that periodic fuel injection through the burners 2, 3 causes periodic loading on the combustion chamber (the outer combustion chamber wall 9*a* and the inner combustion chamber wall 9*b*), which continues into the suspension means of the combustion chamber 1 as described here. With the arrangement described have, each load peak can be countered by a structure selected to match. The quotients cited in the preceding paragraph, or the ratios of the number of openings 13 to the number of burners, give a fixed, reiterative relationship between the thermal/mechanical loading on the combustion chamber suspension means in its totality and each opening in the legs 8*a*, 8*b* owing e resultant mechanical states.

As shown in FIG. 1 the inner combustion chamber wall 9*b* has a recess 16 to accommodate the stator ring 6 immediately downstream of the combustion chamber 1, so that the ring 6 is optimally secured in place by both the combustion chamber 1 and its advantageous suspension means. Shown also on the drawing, between the end section of the outer combustion chamber wall 9*a*, which is followed by the elbow structure 8 of the present invention, and the outer band of the stator ring 6, is a circumferential seal 17 held on the stator ring 6 by a plurality of rivets 18. This and a number of other details, especially of the design type, may nevertheless deviate from the embodiment shown without departing from the content of the claims.

list of reference designators:

1 annular combustion chamber
2 pilot burner
3 main burner
4 exit area
5 nozzle vane
6 stater ring
7 casing wall
7*a* flange
8 elbow structure
8*a* inner leg of 8
8*b* outer leg of 8
8*c* flange
9*a* outer combustion chamber wall
9*b* inner combustion chamber wall
10 bend line
11 longitudinal gas turbine centerline
12 fastening device: bolt-and-nut connection
13 opening, punchout or breakthrough
14 connecting gap
15 sectional plane
16 recess
17 seal

What is claimed is:

1. In a gas turbine engine of the type having a centerline, an inner and outer casing wall, an annular combustion chamber having an exit area and an outer wall, means for suspending said annular gas turbine combustion chamber at its exit area from the outer casing wall comprising an annular elbow structure connected to the outer wall of said combustion chamber, said elbow structure having an outer and an inner leg as viewed with reference to the longitudinal centerline of the gas turbine engine, wherein the outer leg connects to a flange fixedly connected to the casing wall by a detachable fastening device, said elbow structure including a bend line from which each of said legs extends, at least some of one of said outer and inner legs of said elbow structure including an opening extending to said bend line to thereby provide a gap at said bend line.

2. The invention as claimed in claim 1 wherein at least one of the legs has a plurality of circumferentially spaced openings.

3. The invention as claimed in claim 1, further including a plurality of burners equally spaced over the circumference of the combustion chamber and wherein a number of opening are provided in at least one of the legs, the number of openings in at least one of the legs is, when viewed over the circumference of the elbow structure, a multiple "n" of the number of burners, where n=0.5 or 1.0 or 1.5 or 2.0 or 2.5 or 3.0.

4. The invention as claimed in claim 1 further including pilot burners in said combustion chamber and main burners that are equally spaced over the circumference of the combustion chamber and offset relative to each other, wherein each burner has a sectional plane passing therethrough and through a said opening in at least one of the legs.

5. The invention as claimed in claim 1 wherein said combustion chamber has an inner wall and, at its end, said inner combustion chamber wall has a recess to accommodate a stator ring disposed immediately downstream of the combustion chamber.

6. In a gas turbine engine of the type having a centerline, an inner and outer casing wall, an annular combustion chamber having an exit area and an outer wall, means for suspending said annular gas turbine combustion chamber at its exit area from the outer casing wall by an annular elbow structure connected to the outer wall of said combustion chamber, said elbow structure having an outer and an inner leg as viewed with reference to the longitudinal centerline of the gas turbine engine, said outer leg being connected to a flange fixedly connected to the casing wall by a detachable fastening device wherein both legs have dovetail-shaped openings equally spaced over the circumference of the elbow structure and whose narrowest sections face a bend line provided in the elbow structure and open toward said bend line such that a gap is formed between each opening in the outer leg and the adjacent opening in the inner leg.

7. In a gas turbine engine of the type having a centerline, an inner and outer casing wall, an annular combustion chamber having an exit area and an outer wall, means for suspending said annular gas turbine combustion chamber at its exit area from the outer casing wall comprising an annular elbow structure connected to the outer wall of said combustion chamber, said elbow structure having an outer and an inner leg as viewed with reference to the longitudinal centerline of the gas turbine engine, wherein the outer leg connects to a flange fixedly connected to the casing wall by a detachable fastening device, one of said outer and inner legs being provided with a plurality of openings of a size and position to provide a selected degree of flexibility in said elbow structure.

8. The invention as claimed in claim 7 wherein said openings are evenly spaced about said respective leg.

9. The invention as claimed in claim 7 wherein said openings are provided in both of said legs.

10. The invention as claimed in claim 9 wherein said openings are evenly spaced about each of said legs.

* * * * *